US009553369B2

(12) United States Patent
Morin et al.

(10) Patent No.: US 9,553,369 B2
(45) Date of Patent: Jan. 24, 2017

(54) ULTRA-WIDEBAND BICONICAL ANTENNA WITH EXCELLENT GAIN AND IMPEDANCE MATCHING

(71) Applicant: Her Majesty The Queen in Right of Canada, as Represented by the Minister of National Defence, Ottawa (CA)

(72) Inventors: Gilbert A. Morin, Ottawa (CA); Larry Ryan, Ottawa (CA)

(73) Assignee: HER MAJESTY THE QUEEN IN RIGHT OF CANADA, AS REPRESENTED BY THE MINISTER OF NATIONAL DEFENCE, Ottawa, Ontario (CA)

( * ) Notice: Subject to any disclaimer, the term of this patent is extended or adjusted under 35 U.S.C. 154(b) by 225 days.

(21) Appl. No.: 14/175,244

(22) Filed: Feb. 7, 2014

(65) Prior Publication Data

US 2015/0280317 A1 Oct. 1, 2015

(51) Int. Cl.
*H01Q 9/28* (2006.01)
*H01Q 13/04* (2006.01)

(52) U.S. Cl.
CPC ..... *H01Q 9/28* (2013.01); *H01Q 13/04* (2013.01)

(58) Field of Classification Search
None
See application file for complete search history.

(56) References Cited

U.S. PATENT DOCUMENTS

| | | | | |
|---|---|---|---|---|
| 2,175,252 | A | 10/1939 | Carter et al. | |
| 2,541,870 | A | 2/1951 | Green | |
| 5,134,420 | A | 7/1992 | Rosen et al. | |
| 5,367,312 | A | 11/1994 | Masters | |
| 6,943,747 | B2 | 9/2005 | Kwon | |
| 7,453,414 | B2 | 11/2008 | Parsche | |
| 7,538,737 | B2 | 5/2009 | Black et al. | |
| 9,077,080 | B1 * | 7/2015 | Josypenko | H01Q 13/04 |
| 2002/0097190 | A1 | 7/2002 | Wu et al. | |
| 2005/0093756 | A1 | 5/2005 | Martek | |

(Continued)

FOREIGN PATENT DOCUMENTS

WO 99/01909 A1 1/1999

OTHER PUBLICATIONS

Anthony K. Amert et al., "Miniaturization of the Biconical Antenna for Ulrawideband Applications", IEEE Transactions on Antennas and Propagation, vol. 57, No. 12, Dec. 2009.

(Continued)

*Primary Examiner* — Robert Karacsony
(74) *Attorney, Agent, or Firm* — Brion Raffoul

(57) ABSTRACT

Systems and devices relating to a biconical antenna. The antenna has a top cone assembly and a bottom cone assembly, each cone assembly being coupled to a dielectric spacer at its apex. Each cone assembly has a cone section and a truncated cone section. The cone section is a cone with an apex which forms the apex of the cone assembly. The truncated cone section is coupled to the cone of the cone section at the cone's rim. The cone has an opening angle which is larger than the opening angle of the truncated cone. The biconical antenna can be fed by way of a coaxial cable with the outer cable feeding the bottom cone assembly and the inner cable feeding the top cone assembly.

21 Claims, 10 Drawing Sheets

(56) References Cited

U.S. PATENT DOCUMENTS

| | | | | |
|---|---|---|---|---|
| 2005/0156804 | A1* | 7/2005 | Ratni | H01Q 9/28 343/773 |
| 2006/0262020 | A1* | 11/2006 | Kuroda | H01Q 1/38 343/773 |
| 2012/0044119 | A1* | 2/2012 | Libonati | H01Q 9/28 343/807 |
| 2012/0176286 | A1 | 7/2012 | Amert et al. | |

OTHER PUBLICATIONS

Dr. Gilbert A. Morin et al., "DRDC's Ultra Wide-Band Antennas for Counter-IED and Surveillance Applications", Defence R&D Canada.

Dr. Gilbert A. Morin et al., "Ultra-Wideband Antenna Design", CNEW / DRDC Ottaa.

"Ultra-Wideband, Omni-Directional Biconical Antennas", Defence RID Defense, Defence Research and Development Canada.

ISA/CA, "International Search Report and Written Opinion" for PCT/CA2014/051270.

* cited by examiner

ULTRA-WIDEBAND BICONICAL ANTENNA WITH EXCELLENT GAIN AND IMPEDANCE MATCHING

TECHNICAL FIELD

The present invention relates to antennas. More specifically, the present invention relates to an antenna design for use in ultra-wideband applications.

BACKGROUND

Many applications require wideband antennas. Some of these applications are military related and may need an ultra-wideband antenna with an omni-directional pattern and which can be used to illuminate the ground around a vehicle for jamming radio control signals. These radio control signals may be used to detonate improvised explosive devices.

Several dipole-types antennas, forming an antenna farm, have been used with some success but they create a clutter on the vehicle and can interfere with each others. For a single-antenna solution, the bicone has been used by many manufacturers but the problem is that, for ultra-wideband, the beam splits in two parts over some frequency bands and creates nulls or minimums in the directions of interest. Also, it is difficult to maintain a good impedance match over such ultra-widebands.

Because such a wideband antenna will need to be deployed on combat vehicles, such an antenna would need to be ruggedized and designed to withstand at least some of the rigors of combat.

There is therefore a need for an antenna that mitigates if not overcomes the issues with the prior art and which solves at least part of the problems noted above.

SUMMARY OF INVENTION

The present invention provides systems and devices relating to a biconical antenna. The antenna has a top cone assembly and a bottom cone assembly, each cone assembly being coupled to a dielectric spacer at its apex. Each cone assembly has a middle cone section and a topmost cone section. The middle cone section is a cone with an apex which forms the apex of the middle cone assembly. The topmost cone section is coupled to the cone of the middle cone section at the cone's rim. This junction is also called a chine. The middle cone has an opening angle which is larger than the opening angle of the topmost cone. The biconical antenna is fed by way of a coaxial cable with the outer conductor feeding the bottom cone assembly and the inner conductor feeding the top cone assembly.

In a first aspect, the present invention provides an antenna for wideband uses, the antenna comprising:

- a top antenna assembly;
- a bottom antenna assembly;
- a dielectric spacer for coupling said top antenna assembly with said bottom antenna assembly;

wherein

- said top antenna assembly is fed by a coaxial cable passing through said dielectric spacer;
- said top antenna assembly comprises:
  - a middle cone section, said middle cone section being coupled to said dielectric spacer and having a cone shape;
  - a topmost cone section coupled to said middle cone section, said middle cone section being located between said dielectric spacer and said topmost cone section, said topmost cone section having a truncated cone shape, said truncated cone shape having a smaller angle of opening than said cone shape.

In a second aspect, the present invention provides an antenna comprising:

- a top antenna assembly;
- a bottom antenna assembly;
- a dielectric spacer for coupling said top antenna assembly with said bottom antenna assembly;

wherein

- said top antenna assembly comprises:
  - a middle cone section, said middle cone section being coupled to said dielectric spacer and having a cone shape;
  - a topmost cone section coupled to said middle cone section, said middle cone section being located between said dielectric spacer and said topmost cone section, said topmost cone section having a truncated cone shape, said truncated cone shape having a smaller angle of opening than said cone shape;
- said bottom antenna assembly comprises:
  - a feed bottom cone and a skirt, said feed bottom cone being attached to said dielectric spacer and said skirt, said feed bottom cone being located between said dielectric spacer and said skirt. The skirt being a truncated cone section with a wide opening angle but not to the point of making it a plate.

In a third aspect, the present invention provides a component for use in an antenna, the component comprising:

- a middle cone section, said middle cone section being coupled to a dielectric spacer and having a cone shape;
- a topmost cone section coupled to said middle cone section, said middle cone section being located between said dielectric spacer and said topmost cone section, said topmost cone section having a truncated cone shape, said truncated cone shape having a smaller angle of opening than said cone shape;
- an annular groove for impedance matching, said annular groove being located on said middle cone section.

In a fourth aspect, the present invention provides an antenna for wideband uses, the antenna comprising:

- a top antenna assembly;
- a bottom antenna assembly;
- a dielectric spacer for coupling said top antenna assembly with said bottom antenna assembly;

wherein

- said top antenna assembly is fed by a coaxial cable passing through said dielectric spacer;
- said top antenna assembly comprises:
  - a middle cone section, said middle cone section being coupled to said dielectric spacer and having a cone shape;
  - a topmost cone section coupled to said middle cone section, said middle cone section being located between said dielectric spacer and said topmost cone section, said topmost cone section having a truncated cone shape, said truncated cone shape having a smaller angle of opening than said cone shape, and
- said antenna includes at least one annular groove for impedance matching, said at least one annular groove being adjacent to said dielectric spacer and being located on at least one of: said middle cone section of said top antenna assembly, and a middle cone section of said bottom antenna assembly.

In a fifth aspect, the present invention provides an antenna comprising:

a top antenna assembly;

a bottom antenna assembly;

a dielectric spacer for coupling said top antenna assembly with said bottom antenna assembly;

wherein said top antenna assembly comprises:

a middle cone section, said middle cone section being coupled to said dielectric spacer and having a cone shape;

a topmost cone section coupled to said middle cone section, said middle cone section being located between said dielectric spacer and said topmost cone section, said topmost cone section having a truncated cone shape, said truncated cone shape having a smaller angle of opening than said cone shape;

said bottom antenna assembly comprises:

a feed bottom cone and a skirt, said feed bottom cone being attached to said dielectric spacer and said skirt, said feed bottom cone being located between said dielectric spacer and said skirt;

said antenna includes at least one annular groove for impedance matching, said at least one annular groove being adjacent to said dielectric spacer and is located on at least one of: said middle cone section of said top antenna assembly, and said feed bottom cone of said bottom antenna assembly.

In a sixth aspect, the present invention provides a component for use in an antenna, the component comprising:

a middle cone section, said middle cone section being coupled to a dielectric spacer and having a cone shape;

a topmost cone section coupled to said middle cone section, said middle cone section being located between said dielectric spacer and said topmost cone section, said topmost cone section having a truncated cone shape, said truncated cone shape having a smaller angle of opening than said cone shape;

an annular groove for impedance matching, said annular groove being located on said middle cone section and being adjacent to said dielectric spacer.

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1:
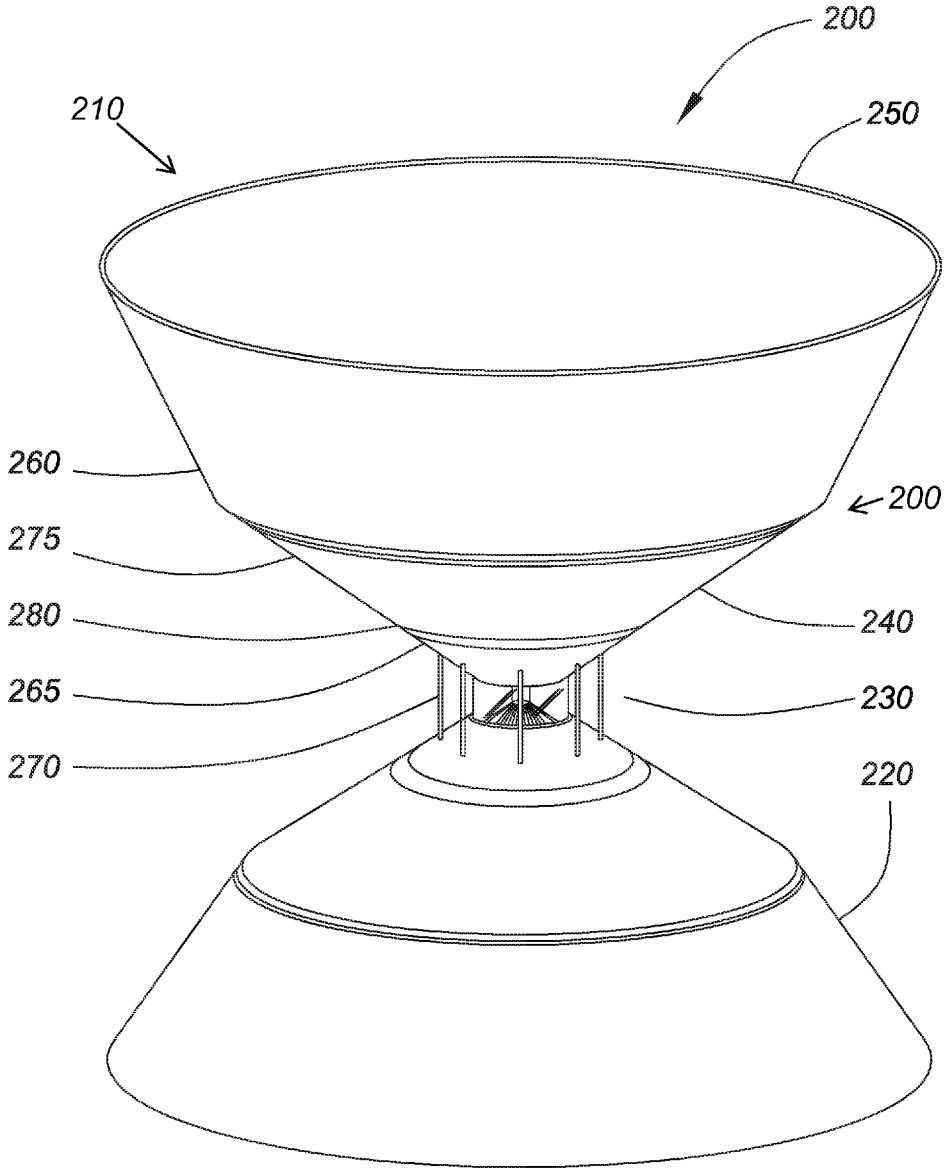
FIG. 1 is a side view of a biconical antenna for mounting on a mast according to one aspect of the invention.

Referring to FIG. 1, a side view of a biconical antenna 200 according to one aspect of the invention is illustrated. The antenna 200 has a top antenna assembly 210 and a bottom antenna assembly 220, both of which are coupled to a dielectric spacer 230 at the apex of each of the antenna assemblies 210, 220.

The parts of the top antenna assembly are similar to the parts of the bottom antenna assembly and, for simplicity, only the parts of the top antenna assembly will be discussed. The assembly 210 has a middle cone 240 and a topmost cone 250. The middle cone 240 and the topmost cone 250 are connected at the rim 260 of the middle cone 240. The rim 260 can also be seen as a chine or a ridge or sharp intersection between a side and a bottom. It should be noted that the middle cone 240 is a cone with its apex terminating at the dielectric spacer 230. The topmost cone 250 is a truncated cone which, if it was a complete cone, has an angle of opening smaller than the cone's angle of opening. Preferably, the cone section's height is equal to the height of the middle cone, thereby locating the chine 260 halfway between the cone's apex at the dielectric spacer 230 and the top rim of the topmost cone. Also preferably, the diameter of the topmost cone's top rim is equal to the total height of the antenna.

To strengthen and support the antenna 200, a number of tensioning cords 270 are provided. These tensioning cords 270 are woven through both the top and the bottom antenna assemblies 210, 220 and are, preferably, under tension.

It should be noted that the middle cone 240 may be constructed from two distinct sections with a joint 280 between the two distinct sections. A feed section 265 and a cone section 275 are indicated in FIG. 1 as being part of the middle cone 240 with a joint 280 between the two sections.

Figure 2:
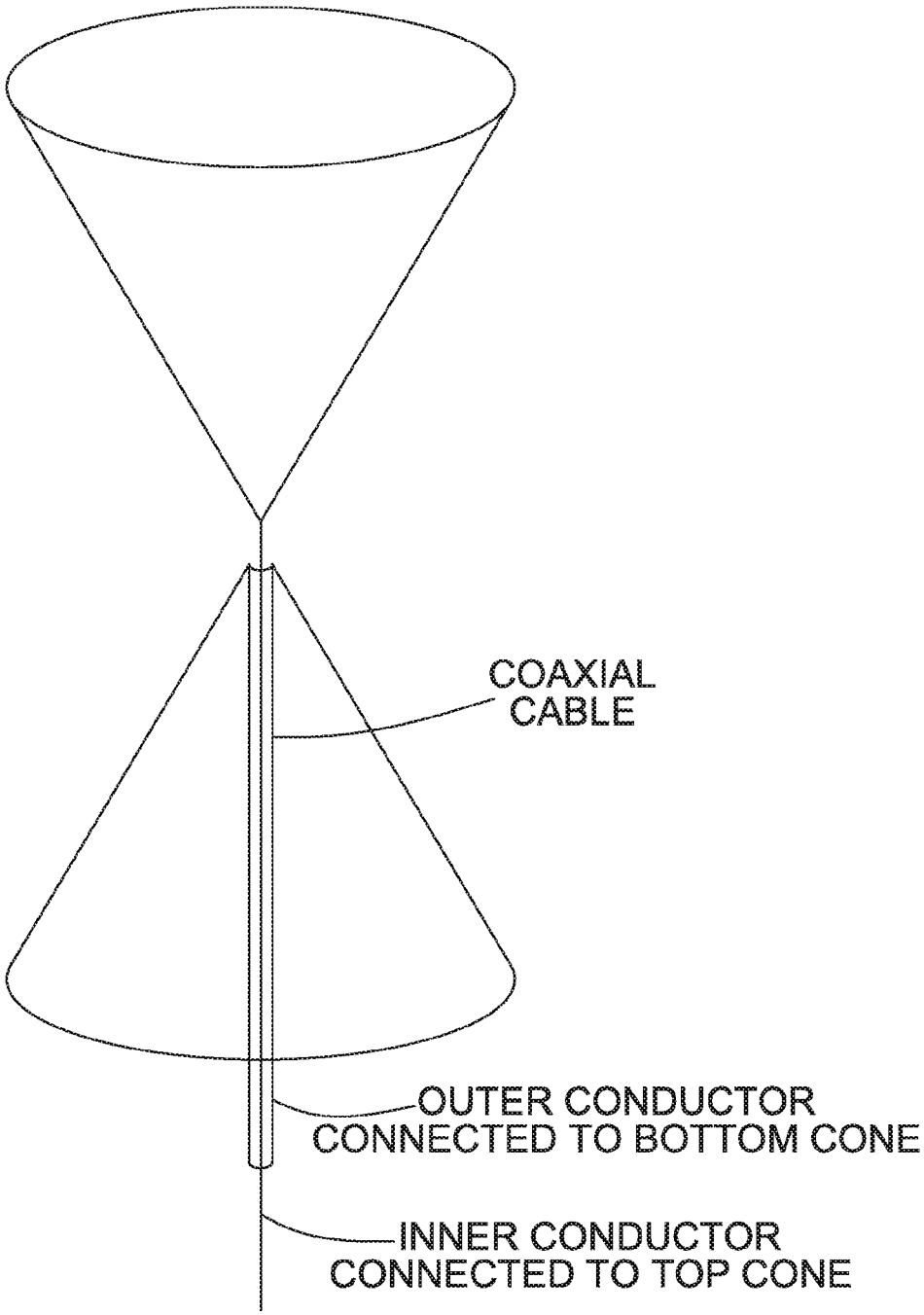
FIG. 2 is a schematic diagram illustrating a scheme for a feed mechanism for the antenna in FIG. 1.

Referring to FIG. 2, a schematic diagram illustrating the feed scheme for one aspect of the invention is presented. As can be seen, the cone sections of the top and bottom antenna assemblies are shown to represent their respective antenna assemblies. Each antenna assembly is electronically isolated from the other antenna assembly. To feed signal into each antenna assembly, a coaxial cable is preferably used. The inner connector of the coaxial cable is used to couple the top antenna assembly to a signal source. The outer connector of the coaxial cable is used to coupled the bottom antenna assembly to the signal source.

Figure 3:
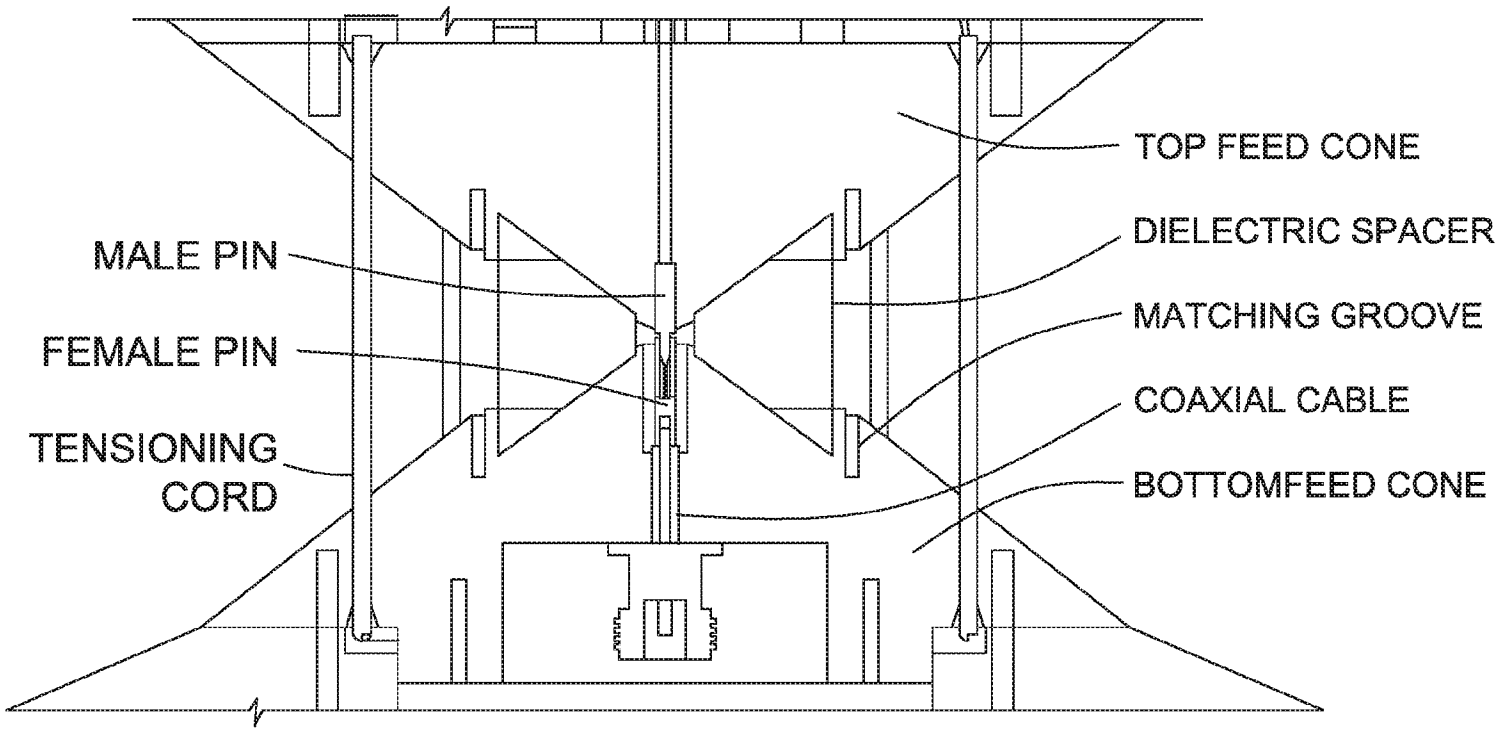
FIG. 3 is a side cut-away view of the antenna apex region in FIG. 1.

To mechanically couple each antenna assembly with the other, a toroid shaped dielectric spacer 230 is used in the feed area of the antenna. It should be noted that the feed area of the antenna includes the upper and lower feed sections of the top and bottom antenna assemblies. The dielectric spacer 230 isolates the two antenna assemblies from each other while providing a channel for the coaxial cable. The dielectric spacer 230 also provides a connection area for the two antenna assemblies to be glued or attached to. To better understand the structure of the antenna, a side cut-away view of the feed area of the antenna is provided in FIG. 3. FIG. 3 illustrates the feed sections of both the upper and lower antenna assemblies. The feed section of the top antenna assembly in FIG. 3 is referenced as a top feed cone while the bottom antenna assembly's feed section is referenced in FIG. 3 as the bottom feed cone. It should be noted that, for simplicity, the cone sections of the middle cones of the top and bottom antenna assemblies have been omitted from FIG. 3.

Referring to FIG. 3, the dielectric spacer 230 has a toroid shape. The dielectric spacer provides a donut-like shape with a void or "donut hole" in the center. The void provides a channel through which the coaxial cable or its connectors can be passed through. As can be seen from FIG. 3, the coaxial cable has a female pin which is constructed and arranged to mate with the male pin in the Figure. The male pin, when coupled with the female pin, connects the inner connector of the coaxial cable with the top antenna assembly while electronically isolating the top antenna assembly from the bottom antenna assembly. The outer connector of the coaxial cable is coupled to the bottom antenna assembly. The tensioning cords 270 used to strengthen the antenna are also shown in FIG. 3.

Figure 4:
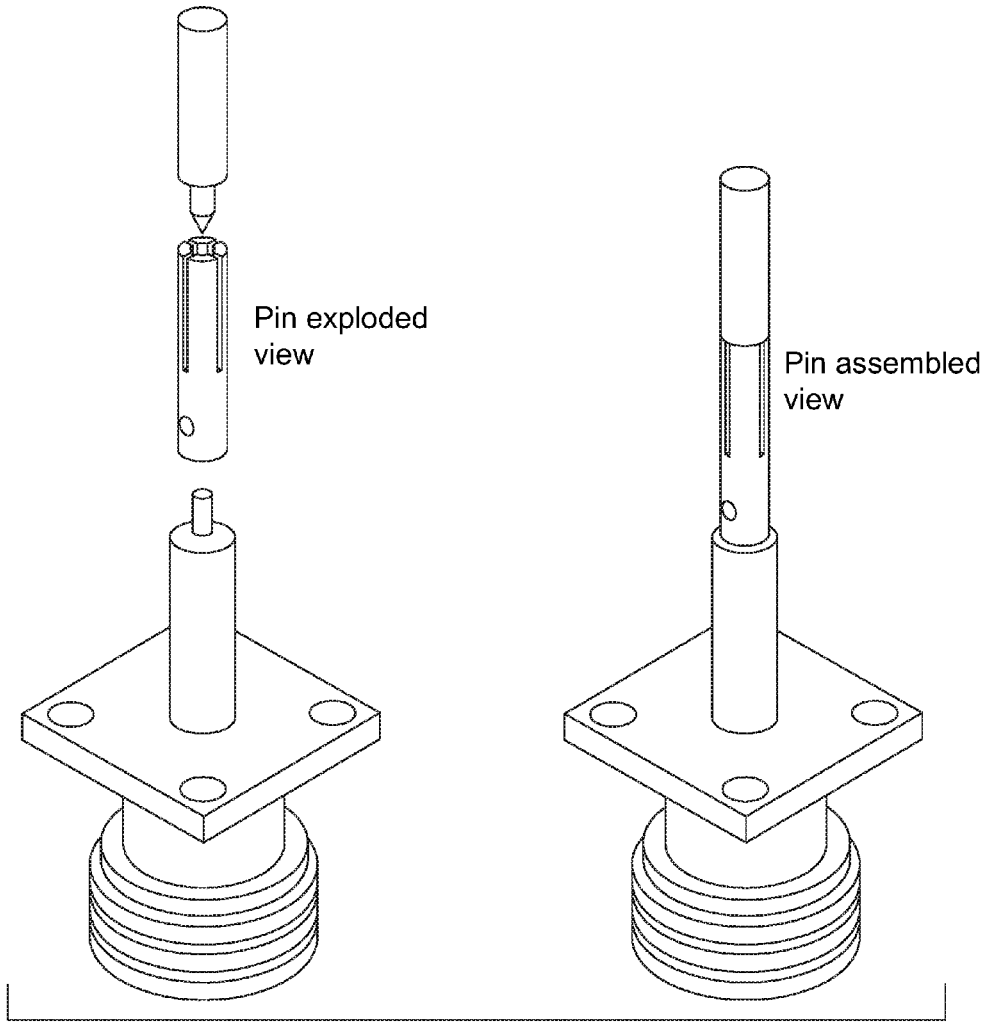
FIG. 4 shows exploded and assembled views of male and female pins connecting the inner conductor of the coaxial cable to the top cone as used in the antenna of FIG. 1.
Figure 5:
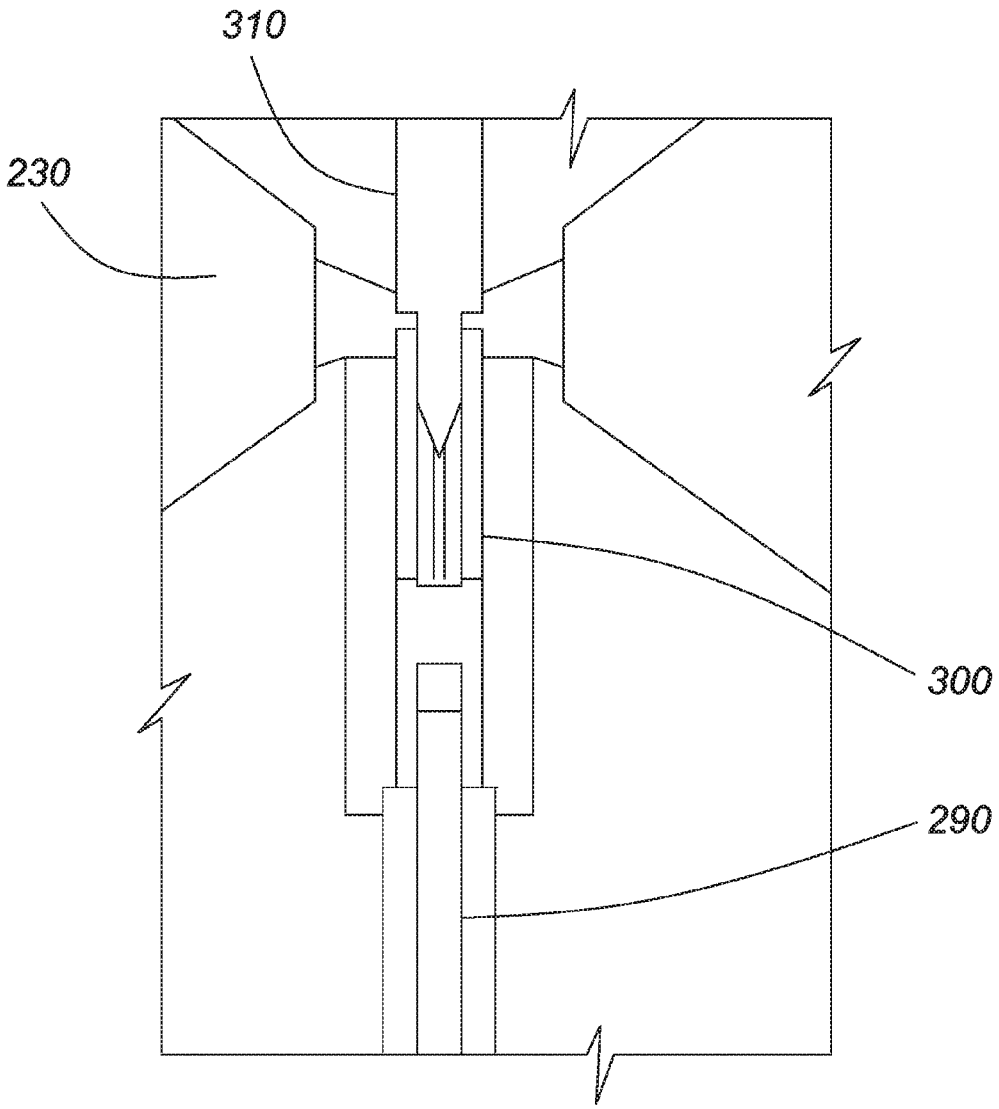
FIG. 5 is a side cut-away view of the assembled male and female pins.

Referring to FIG. 4, exploded and assembled views of the male and female pins are provided. FIG. 5 shows a side cutaway view of the assembled male and female pins. As can be seen, the male pin electronically couples the inner connector 290 with the top antenna assembly by way of the female pin 300. The male pin 310 nests inside the female pin 300. As can be seen, the dielectric spacer 230 has a hole through which the pin connectors 300, 310 pass through.

Figure 6:
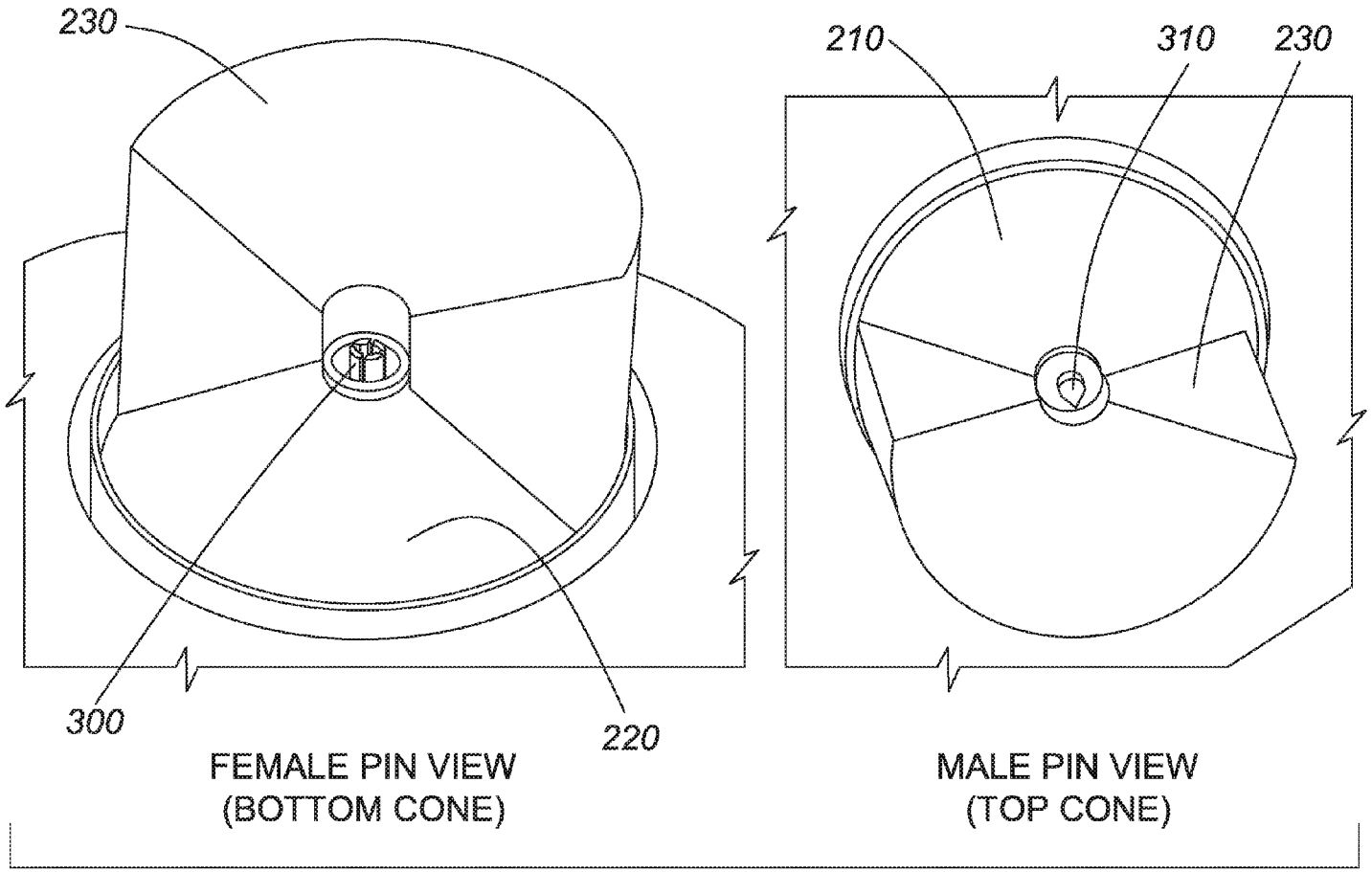
FIG. 6 provides another view of the pin connectors with a cut-away view of the dielectric spacer.

Another view of the pin connectors 300, 310 is provided in FIG. 6. FIG. 6 shows the view from both the top antenna assembly and the bottom antenna assembly. The dielectric spacer 230 is partially cut away to show the male and female pins in the diagram. As can be seen, the dielectric spacer has a concave cross-section to accommodate the feed sections of both the top and bottom antenna assemblies. As can also be seen from FIGS. 3 and 5, the dielectric spacer is shaped such that the top and bottom antenna assemblies are not in physical contact with each other.

Figure 7:
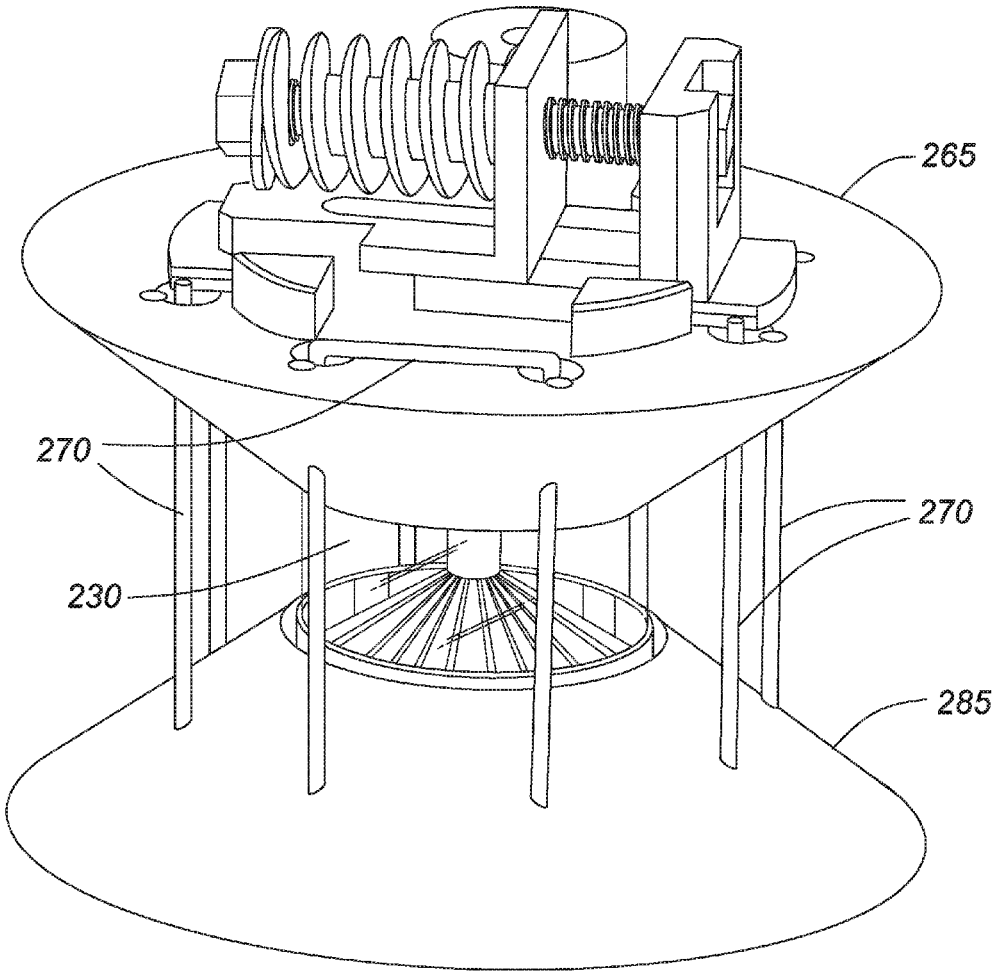
FIG. 7 is a close-up view of the dielectric spacer area of the biconical antenna which shows the cords used for strengthening the antenna structure.

In one implementation, tensioning cords 270 were used to strengthen the structure of the antenna. Referring to FIG. 7, the tensioning cords 270 are shown as being interlaced between the top feed section 265 and bottom feed section 285 of the top and bottom antenna assemblies. This can be used to provide tension in the tensioning cords 270 and thereby strengthens the antenna as the dielectric spacer is squeezed between the top and bottom antenna assemblies. In one implementation, eight cords made from a suitable para-aramid synthetic fiber such as Poly-paraphenylene terephthalamide. This fiber may also be commonly known as Kevlar™ or Twaron™. It should be noted that the middle cones of the antenna are not shown in FIG. 7.

The antenna's structure may be further strengthened by constructing the topmost cone and middle cone sections as a single unit. Furthermore, this single unit can be constructed from ABS (acrylonitrile butadiene styrene) plastic covered with a suitable conductive epoxy resin. The unitary construction in conjunction with the conductive epoxy resin can provide structural strength to the antenna assemblies.

The use of the above materials for the construction of the antenna ruggedizes or renders rugged the antenna. The flexible nature of the cones allows for the cones to absorb any shock delivered to the antenna. This prevents shocks from being transmitted to the feed sections, the feed area, or to the feed itself.

It should be noted that it is preferable for the feed sections for the middle cones of both the top and bottom antenna assemblies to be constructed from a metal material. As noted above, the middle cone can therefore have two sections—a metal feed section including the apex of the middle cone, and a cone section constructed from plastic including the top rim of the cone section which is immediately adjacent the topmost cone. The dielectric spacer can be constructed from a suitable dielectric material such as Rexolite™, a cross linked polystyrene microwave plastic. Preferably, the dielectric spacer is glued to the metal feed sections of the middle cones of the top and bottom antenna assemblies.

Regarding the electrical properties of the antenna, in transmit mode, the electromagnetic wave travels from the coaxial cable, through the feed section (the area of the dielectric spacer), to the antenna assemblies, and radiates out. The feed has to match the wave impedances between the coaxial cable and the antenna assemblies region. Because of the presence of the dielectric spacer (essentially a plastic cylinder or puck), the matching may prove difficult. In the literature, the matching is poor in terms of VSWR and bandwidth. If the feed design is not very good, there will be interactions between the feed and the transition between the truncated cone section and the cone section and the rims of the antenna assemblies. These interactions will create a gain drop, thereby degrading antenna performance.

To address this issue, various angles and a slot in the antenna assembly were used to match all the impedances in various parts of the feed.

Figure 8:
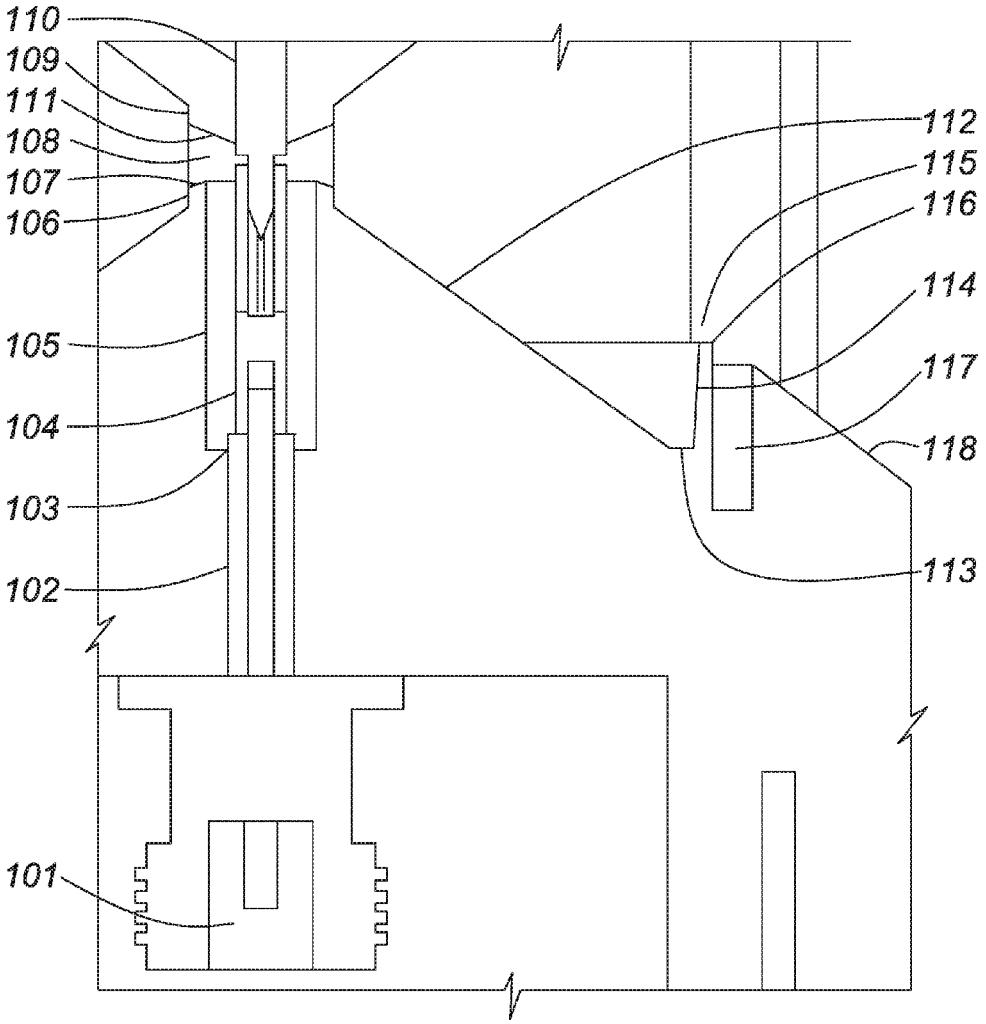
FIG. 8 is a side cut-away view of the dielectric spacer area showing the various components used for impedance matching.

Referring to FIG. 8 a close-up view of the dielectric spacer area adjacent to the feed section of the bottom antenna assembly is illustrated and will be used in conjunction with the description below.

The signal enters the coaxial line at the N-type connector 101. The signal propagates through the coaxial line 102. The coaxial line or cable has a center conductor and a dielectric sleeve (made of Teflon™ in one implementation). The 50-ohm transmission line transitions to a 50-ohm air line 105. The air line inner conductor is made of two commercial pins (female 104 and male 110). To match the two lines, a small step 103, cancels out the extra capacitance at the junction. This step 103 is optimized through simulations.

The female pin 104 connects to the male pin 110. The male pin 110 is embedded in the cone section of the top antenna assembly. The outer conductor of the air line 105 is effectively connected to cone section of the bottom antenna assembly. The two feed sections of the top and bottom antenna assemblies are attached together through the dielectric spacer (mentioned above as preferably being constructed of Rexolite™ and having a donut shape) with glue applied at the face 112, 113, 114 for the bottom feed section and similarly for the top feed section. The steps 106 and 109 are provided to hold the glue back from the air line. These steps 106, 109 and the air gap 108 are tuned out using the step heights and the cone angles 107, 111. This is done through optimization. The cone face 112 is half of a 50-ohm conical transmission line. The diameter of the dielectric spacer is one wavelength at the highest frequency for the antenna's use.

Faces 113 are provided to avoid having a sharp corner. The small angle from vertical of the face 114 is provided to simplify the insertion of the dielectric spacer as well as to simplify glue application. The wall 116 retains the dielectric spacer and strengthens the effect of the glue. The small recess 115 in the dielectric spacer cancels the extra capacitance of the junction between air and the dielectric spacer. The side of the recess 115 is obtained through optimization. The slot or groove 117 cancels out the detrimental effect of the wall 116. The width and depth of the slot or groove 117 are sensitive to tolerance and is preferably optimized through simulation. The outer edge of the slot or groove 117 is the end of the 50-ohm design that started at the connector 101. For simulation purposes, a perfectly matched 50-ohm cone is attached to the edge of the groove. In one implementation, after matching the feed as much as possible, a return loss of 25 dB was obtained.

It should be noted that in some applications, it might be desirable to couple an antenna to a ground plane. In one embodiment of the invention, the bottom antenna assembly is replaced with a "skirt" that sits on the ground and the antenna is coupled directly to the ground plane.

Figure 9:
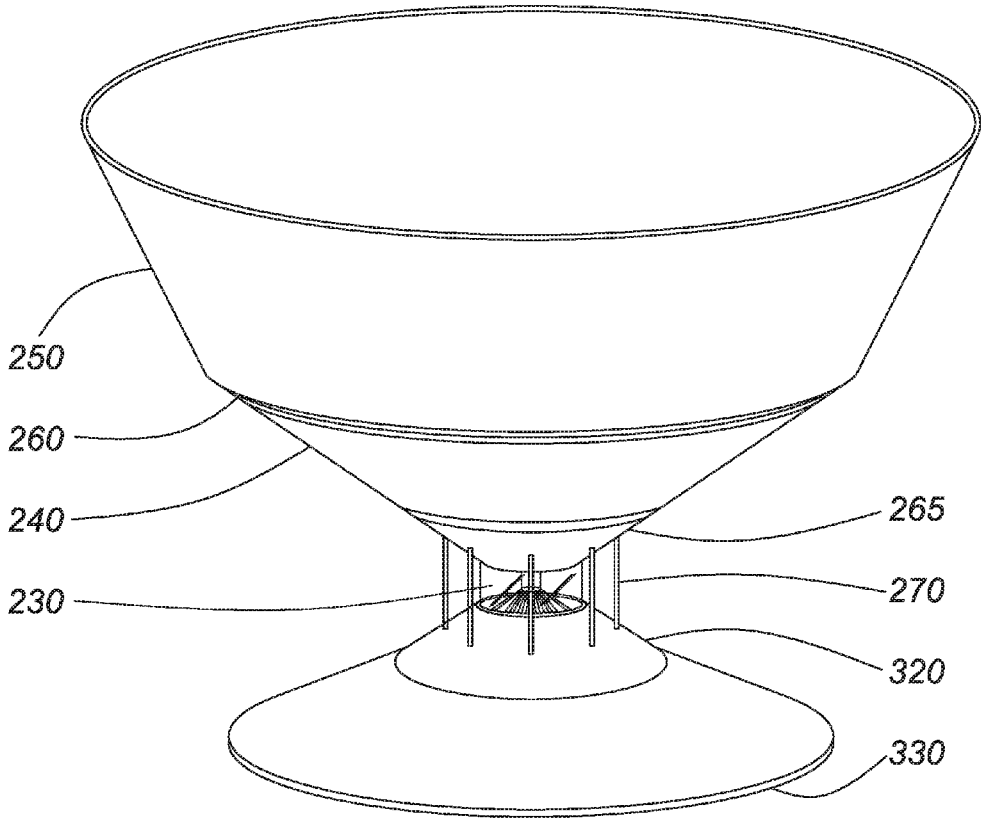
FIG. 9 is a side view of another embodiment of the invention for mounting in proximity of a ground plane according to another aspect of the invention.
Figure 10:
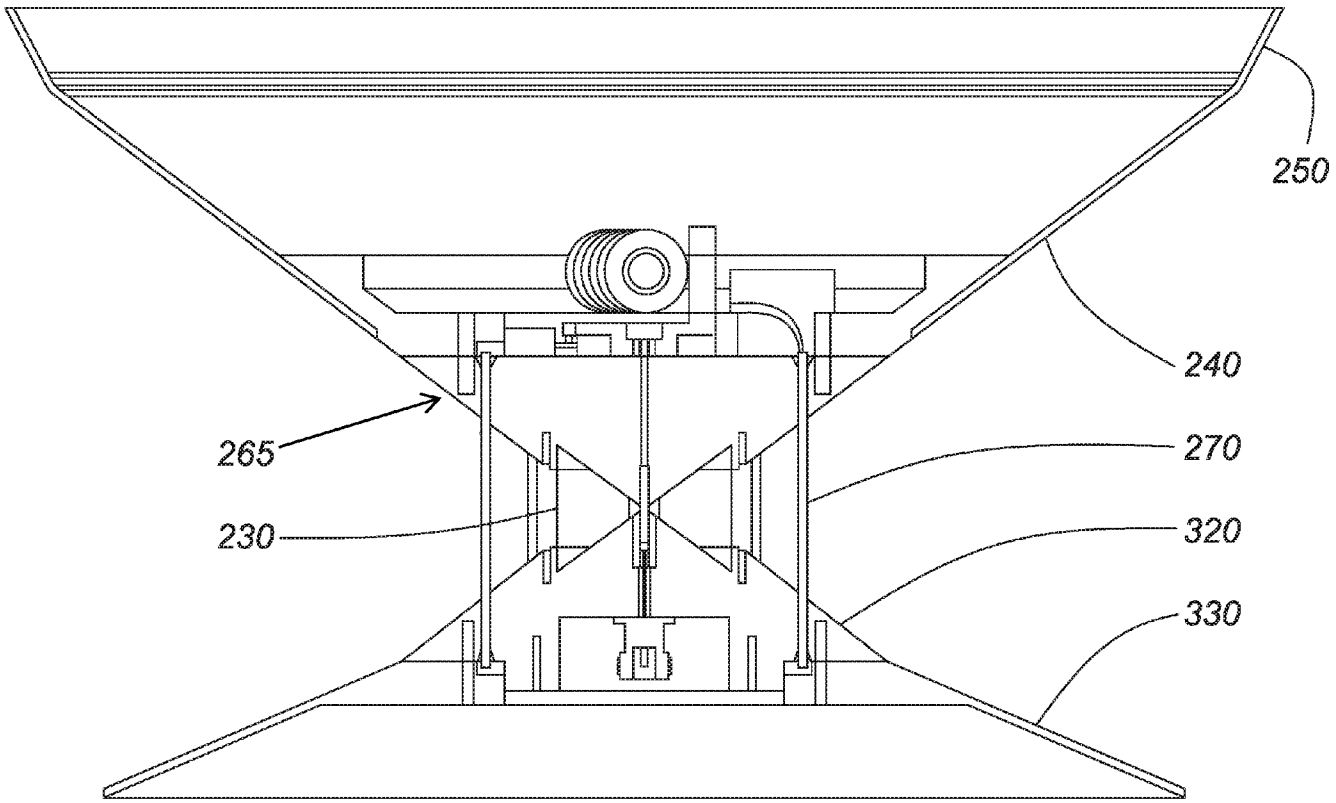
FIG. 10 is a side cut-away view of the antenna illustrated in FIG. 9.

Referring to FIG. 9, a side view of another embodiment of the invention is illustrated. In this embodiment, the top antenna assembly is the same as that for the previously discussed embodiments. The top antenna assembly has a topmost cone 250, a middle cone 240, a feed section 265 and a chine 260. The dielectric spacer 230 and tensioning cords 270 are also unchanged. However, the bottom antenna assembly now only consists of a feed bottom cone 320 and a skirt 330. A side cut-away view of this embodiment of the invention is provided in FIG. 10. As can be seen from FIG. 10, other than the different bottom antenna assembly, this embodiment is similar to the embodiment in FIG. 3.

The feed bottom cone 320 of the bottom antenna assembly is the same as the feed bottom cone as described above. The tensioning cords 270 are interlaced between the top feed cone 265 of the top antenna assembly and the bottom feed cone 320 of the bottom antenna assembly. The dielectric spacer 230 is attached to the same feed cones 265, 320. However, instead of cone and middle cones, a skirt 330 is attached to the feed bottom cone 320 for the bottom antenna assembly. As can be seen, the skirt provides stability for the antenna.

Regarding dimensions, the skirt diameter can be chosen to be approximately two-thirds of the top rim diameter for the topmost cone. Preferably, the distance from the skirt to the ground is as small as possible. Because a coaxial line or cable must run through the space between the skirt and ground, this space cannot be made arbitrarily small. Below the skirt and between the skirt and the ground, there is airspace that can resonate at some discrete frequencies. To avoid this, as it will affect the antenna pattern, an absorbing material may be used to eliminate any resonance.

A person understanding this invention may now conceive of alternative structures and embodiments or variations of the above all of which are intended to fall within the scope of the invention as defined in the claims that follow.

We claim:

1. An antenna for wideband uses, the antenna comprising:
a top antenna assembly;
a bottom antenna assembly;
a dielectric spacer for coupling said top antenna assembly with said bottom antenna assembly;
wherein
said top antenna assembly is fed by a coaxial cable passing through said dielectric spacer;
said top antenna assembly comprises:
a middle cone section, said middle cone section being coupled to said dielectric spacer and having a cone shape;
a topmost cone section coupled to said middle cone section, said middle cone section being located between said dielectric spacer and said topmost cone section, said topmost cone section having a truncated cone shape, said truncated cone shape having a smaller angle of opening than said cone shape, and
said antenna includes at least one annular groove for impedance matching, said at least one annular groove being adjacent to said dielectric spacer and being located on at least one of: said middle cone section of said top antenna assembly, and a middle cone section of said bottom antenna assembly.

2. The antenna according to claim 1, wherein a structure of said bottom antenna assembly is identical to a corresponding structure of said top antenna assembly.

3. The antenna according to claim 1, wherein said bottom antenna assembly comprises a feed bottom cone and a skirt, said feed bottom cone being attached to said dielectric spacer and said skirt, said feed bottom cone being located between said dielectric spacer and said skirt.

4. The antenna according to claim 1, further comprising cords interlaced between said top and bottom antenna assemblies, said cords being for strengthening said antenna.

5. The antenna according to claim 1, wherein said top antenna assembly is constructed from acrylonitrile butadiene styrene (ABS) plastic covered with a conductive epoxy resin.

6. The antenna according to claim 2, wherein said top and bottom antenna assemblies are constructed from acrylonitrile butadiene styrene (ABS) plastic covered with a conductive epoxy resin.

7. The antenna according to claim 1, wherein said dielectric spacer is constructed from a dielectric material.

8. The antenna according to claim 1, wherein a height of said middle cone section is equal to a height of said topmost cone section.

9. The antenna according to claim 1, wherein a top rim of said topmost cone section has a diameter equal to a total combined height of said middle cone section and said topmost cone section.

10. The antenna according to claim 1, wherein said antenna is ruggedized against damage such that any shock delivered to said cone sections is not transmitted to electronics in said middle cone section.

11. The antenna according to claim 1, wherein said middle cone section comprises a feed section and a cone section.

12. An antenna comprising:
a top antenna assembly;
a bottom antenna assembly;
a dielectric spacer for coupling said top antenna assembly with said bottom antenna assembly;
wherein
said top antenna assembly comprises:
a middle cone section, said middle cone section being coupled to said dielectric spacer and having a cone shape;
a topmost cone section coupled to said middle cone section, said middle cone section being located between said dielectric spacer and said topmost cone section, said topmost cone section having a truncated cone shape, said truncated cone shape having a smaller angle of opening than said cone shape;
said bottom antenna assembly comprises:
a feed bottom cone and a skirt, said feed bottom cone being attached to said dielectric spacer and said skirt, said feed bottom cone being located between said dielectric spacer and said skirt;
said antenna includes at least one annular groove for impedance matching, said at least one annular groove being adjacent to said dielectric spacer and is located on at least one of: said middle cone section of said top antenna assembly, and said feed bottom cone of said bottom antenna assembly.

13. The antenna according to claim 12, wherein a height of said middle cone section is equal to a height of said topmost cone section.

14. The antenna according to claim 12, wherein a top rim of said topmost cone section has a diameter equal to a total combined height of said middle cone section and said topmost cone section.

15. The antenna according to claim 12, wherein said antenna is ruggedized against damage such that any shock delivered to said cone sections is not transmitted to electronics in said feed bottom cone.

16. The antenna according to claim 12, wherein said middle cone section comprises a feed section and a cone section, said feed section containing electronics for said antenna.

17. A component for use in an antenna, the component comprising:

a middle cone section, said middle cone section being coupled to a dielectric spacer and having a cone shape;

a topmost cone section coupled to said middle cone section, said middle cone section being located between said dielectric spacer and said topmost cone section, said topmost cone section having a truncated cone shape, said truncated cone shape having a smaller angle of opening than said cone shape;

an annular groove for impedance matching, said annular groove being located on said middle cone section and being adjacent to said dielectric spacer.

18. The component according to claim 17, wherein a height of said middle cone section is equal to a height of said topmost cone section.

19. The component according to claim 17, wherein a top rim of said topmost cone section has a diameter equal to a total combined height of said middle cone section and said topmost cone section.

20. The component according to claim 17, wherein said component is ruggedized against damage such that any shock delivered to cone sections is absorbed by said cone sections and is not transmitted to electronics of said component.

21. The component according to claim 17, wherein said middle cone section comprises a feed section and a cone section, said feed section containing said annular groove.

* * * * *